US009993866B2

(12) United States Patent
Nakamura et al.

(10) Patent No.: US 9,993,866 B2
(45) Date of Patent: Jun. 12, 2018

(54) PRESS FORMING APPARATUS AND PRESS FORMING METHOD FOR A SEMI-SOLID METAL MATERIAL

(71) Applicant: AIDA ENGINEERING, LTD., Kanagawa (JP)

(72) Inventors: Seiji Nakamura, Kanagawa (JP); Yuji Abe, Kanagawa (JP); Setsuo Toda, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 319 days.

(21) Appl. No.: 14/932,885

(22) Filed: Nov. 4, 2015

(65) Prior Publication Data

US 2016/0136711 A1 May 19, 2016

(30) Foreign Application Priority Data

Nov. 6, 2014 (JP) ..... 2014-225761

(51) Int. Cl.
*B21J 9/12* (2006.01)
*B22D 17/00* (2006.01)
(Continued)

(52) U.S. Cl.
CPC ..... *B22D 17/007* (2013.01); *B21J 5/002* (2013.01); *B21J 9/12* (2013.01); *B30B 11/022* (2013.01); *B21J 9/20* (2013.01); *B30B 15/161* (2013.01)

(58) Field of Classification Search
CPC ..... B30B 1/007; B30B 1/23; B30B 11/022; B30B 11/04; B30B 15/0052; B30B 15/16;
(Continued)

(56) References Cited

U.S. PATENT DOCUMENTS 5,526,738 A * 6/1996 Logan ..... B30B 15/16 100/269.14
6,305,925 B1 * 10/2001 Cassani ..... B28B 3/003 425/405.1

(Continued)

FOREIGN PATENT DOCUMENTS

DE 4109407 A1 9/1992
DE 60006604 T2 9/2004

(Continued)

OTHER PUBLICATIONS

Tsukasa Matsuo, "8 Practical Use and Future of Semi-Solid Press Forge Processing Technology", Japan Society for Technology of Plasticity, Jun. 27, 2014, 309th Symposium for Technology of Plasticity, pp. 61-68.

(Continued)

*Primary Examiner* — Edward Tolan
(74) *Attorney, Agent, or Firm* — McDermott Will & Emery LLP

(57) ABSTRACT

Provided is a press forming apparatus for a semi-solid metal material, including: a slide caused to make a reciprocating linear motion; a sub-slide mounted so as to be movable relatively to the slide; a fluid pressure mechanism interposed between the slide and the sub-slide, which is capable of moving the sub-slide relatively to the slide by fluid pressure; an upper die mounted to the sub-slide; and a lower die. The press forming apparatus is configured to press-form the material while applying predetermined pressure to the material for a predetermined period by bringing, along with descent action of the slide, the upper die into contact with the material fed into the lower die, then stopping the slide at a predetermined position, and moving the upper die mounted to the sub-slide relatively to the slide by the fluid pressure mechanism under a state in which the slide is stopped.

8 Claims, 17 Drawing Sheets

(51) Int. Cl.

| | |
|---|---|
| ***B30B 11/02*** | (2006.01) |
| ***B21J 5/00*** | (2006.01) |
| *B30B 15/16* | (2006.01) |
| *B21J 9/20* | (2006.01) |

(58) Field of Classification Search
CPC ..... B30B 15/161; B30B 15/18; B30B 15/22; B22D 17/007; B21J 5/002; B21J 9/02; B21J 9/12; B21J 9/20
See application file for complete search history.

(56) References Cited

U.S. PATENT DOCUMENTS

| | | | | |
|---|---|---|---|---|
| 8,915,181 | B2 * | 12/2014 | Kohno | B30B 15/284 100/46 |
| 2009/0090161 | A1 * | 4/2009 | Amino | B21D 22/22 72/453.12 |
| 2014/0208964 | A1 * | 7/2014 | Kohno | B30B 1/265 100/35 |
| 2014/0318390 | A1 * | 10/2014 | Bauersachs | B30B 1/32 100/35 |

FOREIGN PATENT DOCUMENTS

| | | | |
|---|---|---|---|
| JP | 04-327358 | A | 11/1992 |
| JP | 2005-034852 | A | 2/2005 |
| JP | 2007-118030 | A | 5/2007 |
| JP | 2012-086246 | A | 5/2012 |
| JP | 2013-220475 | A | 10/2013 |
| JP | 2014-144470 | A | 8/2014 |

OTHER PUBLICATIONS

Office Action Japanese Patent Application No. 2014-225761 dated May 31, 2016.
German Office Action issued in corresponding German Patent Application No. 102015220842.7, dated Feb. 21, 2018.

* cited by examiner

A: POSITION OF MAIN SLIDE (RELATIVE POSITION TO BOLSTER)

B: POSITION OF HYDRAULIC PISTON IN MAIN SLIDE (RELATIVE POSITION TO MAIN SLIDE)

C: POSITION OF UPPER DIE, POSITION OF SUBSIDIARY SLIDE (RELATIVE POSITION TO BOLSTER)

D: PRESSURE ON HYDRAULIC PISTON IN MAIN SLIDE

E: PRESSURE ON MATERIAL TO BE PROCESSED

T.D.C: TOP DEAD CENTER

B.D.C: BOTTOM DEAD CENTER

【POSITION OF SLIDE】 (POSITION OF SLIDE 25)

【 LOAD 】 (PRESSURE IN HYDRAULIC CHAMBER 23)

PRESS FORMING APPARATUS AND PRESS FORMING METHOD FOR A SEMI-SOLID METAL MATERIAL

CROSS-REFERENCE TO RELATED APPLICATIONS

Related Applications

This Application claims priority to Japanese Patent Application No. 2014-225761 filed Nov. 6, 2014, the subject matter of which is incorporated herein by reference in entirety.

BACKGROUND OF THE INVENTION

Field of the Invention

The present invention relates to a press forming apparatus and a press forming method for a semi-solid metal material, which are configured to form mainly light metal, such as an aluminum alloy, and other kinds of metal under a semi-solid state.

Background

Hitherto, as a technology of forming an aluminum alloy and the like, there has been used a casting method such as a die casting method, which involves injecting molten metal into a die under pressure so as to obtain a product having a predetermined shape. When the molten metal is used, there arise problems such as short lifetime of the die, and unsatisfactory quality of a product caused by generation of a shrinkage cavity or the like.

Accordingly, in recent years, there has been used a casting method to be performed under high pressure with the die casting machine by using, as a metal material to be injected into the die instead of the molten metal, metal (semi-solid metal or semi-molten metal) assuming a semi-molten state in which a solid phase component and a liquid phase component coexist.

In this method, the semi-solid metal (hereinafter encompassing the semi-molten metal) is formed in a die under pressure. When solidifying, a contraction ratio of the semi-solid metal is approximately 3.5%, whereas a contraction ratio of the molten metal is approximately 7%. Accordingly, the semi-solid metal has the contraction ratio that is approximately half the contraction ratio of the molten metal, but it is difficult to prevent defects such as a minute shrinkage hole and a blowhole from being generated in a formed product.

In this context, for example, in Patent Literature 1, the applicant of the present invention proposes a method of forming semi-solid metal by using a press machine including a mechanism configured to convert a rotary motion of a power source into a reciprocating linear motion of a slide (die). According to this method, it is possible to form a product that is free from trapped gas, contamination due to an oxide film, and a shrinkage cavity, and is excellent in mechanical properties.

Further, in Patent Literature 2, there is reported that mass production of a rice cooker is carried out by using a hydraulic press.

Here, Patent Literature 1 corresponds to "Japanese Patent Application Laid-open No. 2007-118030", and Patent Literature 2 corresponds to "MATSUO Tsukasa: "8 Practical Use and Future of Semi-Solid Press Forge Processing Technology", the Japan Society for Technology of Plasticity, Jun. 27, 2014, the 309th Symposium for Technology of Plasticity, "Forefront of Application of Semi-Molten and Semi-Solid Processing and Basic Technology Supporting This Processing", pp. 61-68."

However, in the forming method described in Patent Literature 1 or Patent Literature 2, in actuality, sufficient consideration is not given to shrinkage (volume reduction resulting from cooling) caused when press forming is performed by using the semi-molten metal or the semi-solid metal.

That is, in the forming method described in Patent Literature 1 or Patent Literature 2, in order to cope with the problem of shrinkage (volume reduction), for example, it is necessary to divide an upper die or a lower die into a plurality of pieces, and to cause the divided pieces of the die to make relative movement in accordance with shrinkage, thereby changing a cavity volume of the die. For example, a minute gap is formed between the divided pieces of the die, which may adversely affect quality of a formed product, and may lead to increase in cost and complication of the apparatus and equipment. In addition, in actuality, it is difficult to apply the above-mentioned method to press forming to be performed under high pressure, and problems relating to durability and reliability may arise.

SUMMARY OF THE INVENTION

According to one embodiment of the present invention, there is provided a press forming apparatus for a semi-solid metal material, including:

a slide caused to make a reciprocating linear motion by a mechanism configured to convert a rotary motion of a power source into the reciprocating linear motion;

a subsidiary slide mounted so as to be movable relatively to the slide in a reciprocating moving direction of the slide;

a fluid pressure mechanism interposed between the slide and the subsidiary slide, which is capable of moving the subsidiary slide relatively to the slide by fluid pressure;

an upper die mounted to the subsidiary slide; and a lower die, the press forming apparatus being configured to press-form the semi-solid metal material while applying predetermined pressure to the semi-solid metal material for a predetermined time period by bringing, along with descent action of the slide, the upper die into contact with the semi-solid metal material fed (or supplied) into the lower die, then stopping the slide at a predetermined position, and moving the upper die mounted to the subsidiary slide relatively to the slide by the fluid pressure mechanism under a state in which the slide is stopped.

Note that, the predetermined pressure is, for example, pressure (corresponding to press load) required to perform press forming in order to obtain a desired finished product. Description that "the pressure is substantially uniform" encompasses a case of applying the pressure under vibration and a case of switching magnitude of the pressure. Further, as the predetermined time period, there is assumed, as an example, a time period from start of application of the predetermined pressure until substantial settlement of solidification and contraction of the semi-solid metal material being a material to be processed.

Further, in the press forming apparatus for a semi-solid metal material according to the one embodiment of the present invention, until the slide is stopped at the predetermined position after bringing, along with the descent action of the slide, the upper die mounted to the subsidiary slide into contact with the semi-solid metal material fed into the lower die, and while the slide performs the descent action, pressure applied to the semi-solid metal material may be controlled to the predetermined pressure by moving the upper die mounted to the subsidiary slide upward relatively to the slide by the fluid pressure mechanism.

Further, in the press forming apparatus for a semi-solid metal material according to the one embodiment of the present invention, the pressure applied to the semi-solid metal material may be controlled to the predetermined pressure by controlling the pressure to substantially uniform pressure.

Further, in the press forming apparatus for a semi-solid metal material according to the one embodiment of the present invention, the pressure applied to the semi-solid metal material may be controlled to the predetermined pressure by controlling the pressure under predetermined vibration.

Further, in the press forming apparatus for a semi-solid metal material according to the one embodiment of the present invention, while applying the predetermined pressure to the semi-solid metal material for the predetermined time period, the pressure applied to the semi-solid metal material may be switched to another predetermined pressure.

According to one embodiment of the present invention, there is provided a press forming method for a semi-solid metal material using a press machine, the press machine including:

a slide caused to make a reciprocating linear motion by a mechanism configured to convert a rotary motion of a power source into the reciprocating linear motion;

a subsidiary slide mounted so as to be movable relatively to the slide in a reciprocating moving direction of the slide;

a fluid pressure mechanism interposed between the slide and the subsidiary slide, which is capable of moving the subsidiary slide relatively to the slide by fluid pressure;

an upper die mounted to the subsidiary slide; and a lower die, the press forming method including press-forming the semi-solid metal material while applying predetermined pressure to the semi-solid metal material for a predetermined time period by bringing, along with descent action of the slide, the upper die into contact with the semi-solid metal material fed into the lower die, then stopping the slide at a predetermined position, and moving the upper die mounted to the subsidiary slide relatively to the slide by the fluid pressure mechanism under a state in which the slide is stopped.

Further, the press forming method for a semi-solid metal material according to the one embodiment of the present invention may further include controlling, until the slide is stopped at the predetermined position after bringing, along with the descent action of the slide, the upper die mounted to the subsidiary slide into contact with the semi-solid metal material fed into the lower die, and while the slide performs the descent action, pressure applied to the semi-solid metal material to the predetermined pressure by moving the upper die mounted to the subsidiary slide upward relatively to the slide by the fluid pressure mechanism.

Further, in the press forming method for a semi-solid metal material according to the one embodiment of the present invention, the controlling the pressure applied to the semi-solid metal material to the predetermined pressure may include controlling the pressure to substantially uniform pressure.

Further, in the press forming method for a semi-solid metal material according to the one embodiment of the present invention, the controlling the pressure applied to the semi-solid metal material to the predetermined pressure may include controlling the pressure under predetermined vibration.

Further, the press forming method for a semi-solid metal material according to the one embodiment of the present invention may further include switching, while applying the predetermined pressure to the semi-solid metal material for the predetermined time period, the pressure applied to the semi-solid metal material to another predetermined pressure.

DETAILED DESCRIPTION OF THE PREFERRED EMBODIMENTS

The present invention has an object to provide a press forming apparatus and a press forming method for a semi-solid metal material using a press machine including a mechanism configured to convert a rotary motion of a power source into a reciprocating linear motion of a slide. The press forming apparatus and the press forming method are capable of obtaining, with a simple and low-cost configuration, a formed product that is free from defects such as a shrinkage cavity, a shrinkage hole, and a blowhole, and is excellent in mechanical properties.

Now, a press forming method and a press forming apparatus for a semi-solid metal material according to embodiments of the present invention are described with reference to the attached drawings. Note that, the present invention is not limited to the embodiments described below.

First Embodiment

<Press Forming Method Carried Out at Variable Speed Using Application of Pressure at Bottom Dead Center (B.D.C)>

Figure 8:
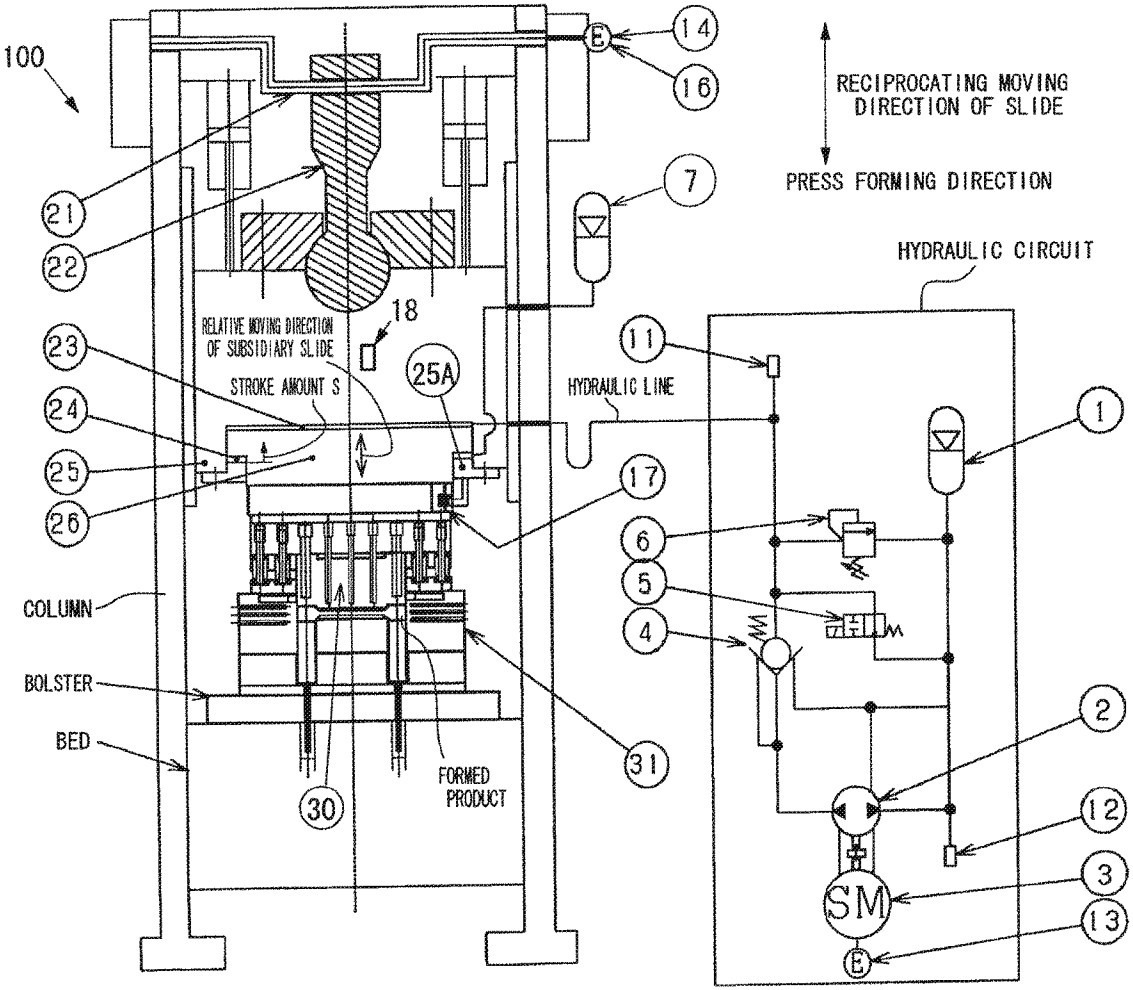
FIG. 8 is a schematic view for illustrating an example of the press forming apparatus for a semi-solid metal material and a hydraulic mechanism (fluid pressure mechanism) according to the first embodiment.

Note that, as illustrated in FIG. 8, the press forming apparatus (press machine) according to the present invention is a press forming apparatus (press machine) including a main slide 25 (slide according to the present invention) that is connected to a rotary motion-linear motion converting mechanism (such as a crank mechanism, an eccentric cam mechanism, or a link mechanism) configured to convert a rotary motion of a power source into a reciprocating linear motion, and is configured to make the reciprocating linear motion.

In a first embodiment of the present invention, press forming is carried out in the following steps.

Figure 1:
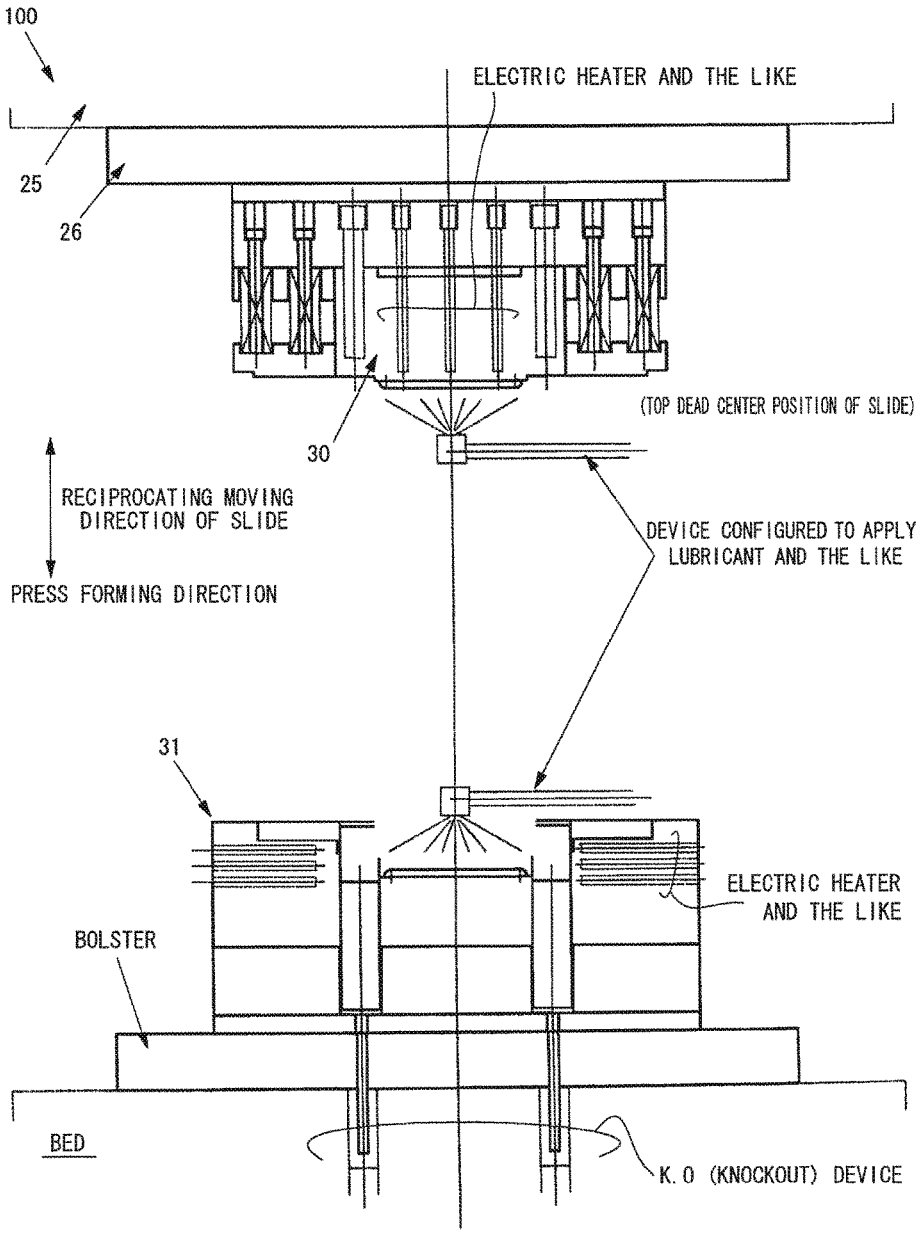
FIG. 1 is a front view of a press forming apparatus for a semi-solid metal material according to a first embodiment of the present invention (under a state in which a slide is at a top dead center position).

In Step 1, under a state in which a press machine 100 corresponding to the press forming apparatus according to the present invention is at a top dead center (T.D.C) (under a state in which the slide is at a top dead center position), a releasing agent or a lubricant is applied or sprayed onto inner surfaces of cavities of an upper die 30 and a lower die 31 (see FIG. 1).

Figure 2:
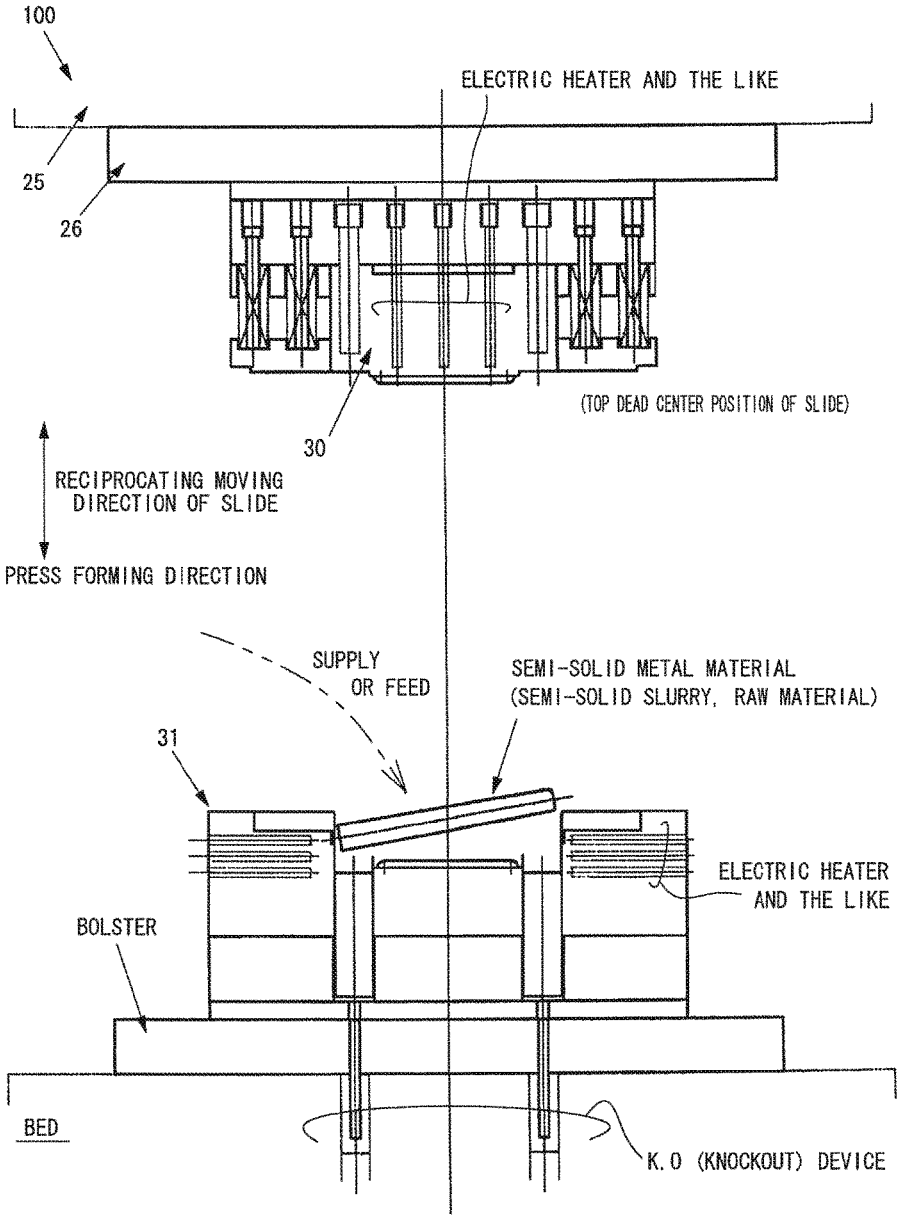
FIG. 2 is a front view of the press forming apparatus for a semi-solid metal material according to the first embodiment (under a state in which the semi-solid metal material (raw material) is fed into a lower die: Step 1).
Figures 7A, 7B, 7C:
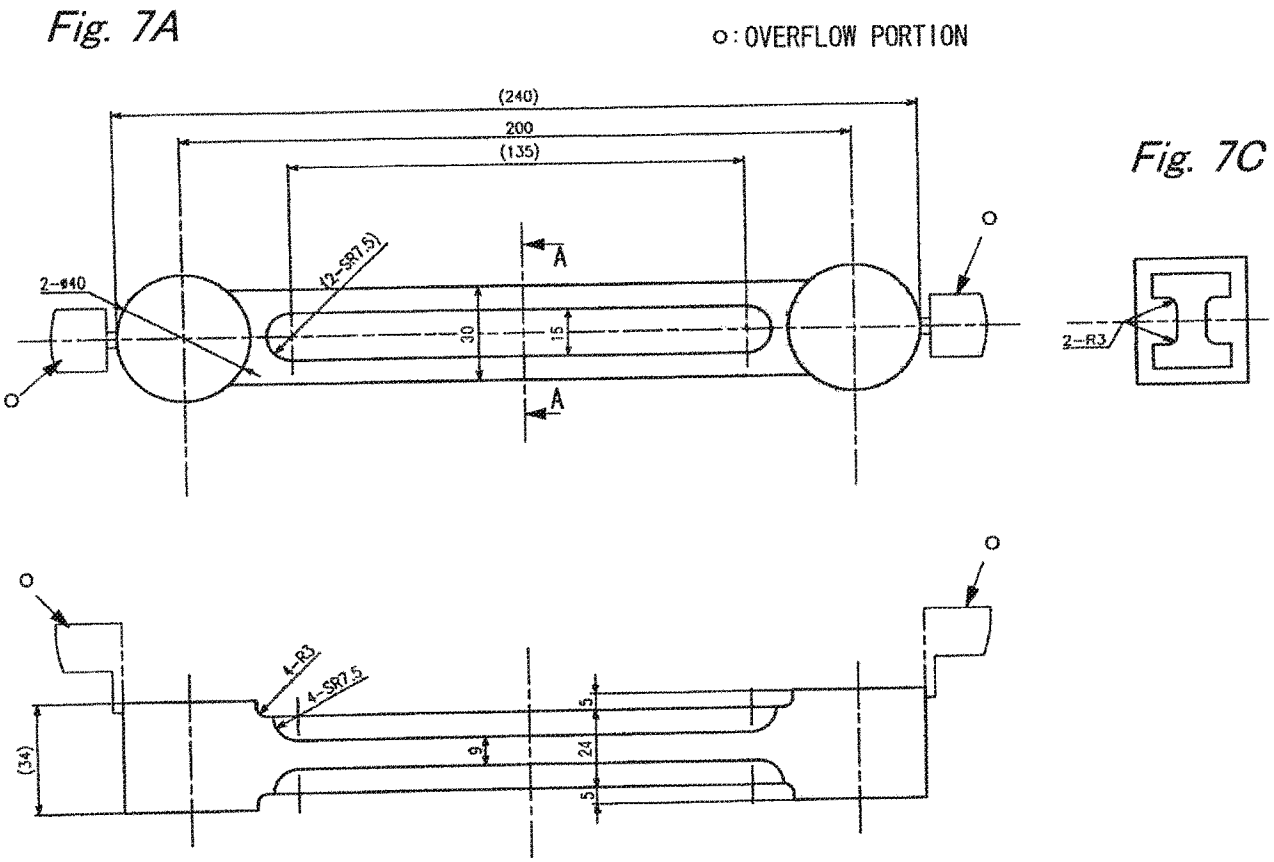
FIG. 7A is a plan view for illustrating a shape of the formed product after finish of forming according to the first embodiment.
FIG. 7B is a side view of FIG. 7A.
FIG. 7C is a sectional view taken along the line A-A of FIG. 7A.

After that, the semi-solid metal material (semi-solid material, semi-solid slurry) (raw material, material to be processed) having a solid phase ratio of 30% to 90%, which is previously obtained by cooling molten metal in a container while electromagnetically stirring the molten metal by an electromagnetic stirring device or the like, is fed into the cavity (recessed portion) of the lower die 31 (see FIG. 2). Note that, a finished formed product is, for example, a link component (such as a connecting rod) as illustrated in FIG. 7A to FIG. 7C.

An electric heater (see FIG. 1 or FIG. 2), a temperature sensor (thermocouple), and the like are arranged on the upper die 30 and the lower die 31 as needed. This configuration enables control of keeping the semi-solid metal material (raw material) at a predetermined temperature.

Figure 3:
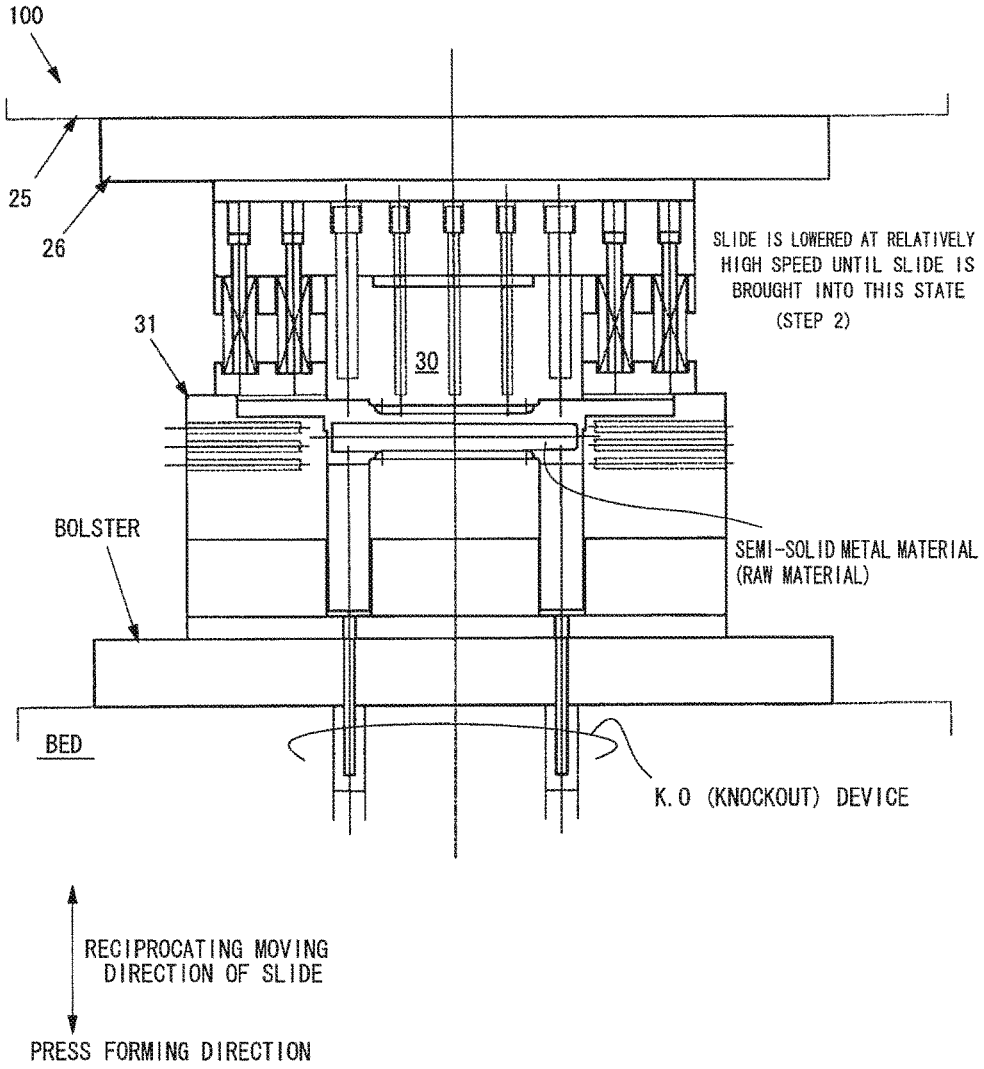
FIG. 3 is a front view of the press forming apparatus for a semi-solid metal material according to the first embodiment (under a state in which the slide is lowered at high speed until the slide is brought into contact with the semi-solid metal material (raw material): Step 2).

In Step 2, after charging the semi-solid metal material (raw material) in Step 1, the main slide 25 is lowered to start forming action. Until immediately before the upper die 30 is brought into contact with the semi-solid metal material (raw material) (see FIG. 3), the main slide 25 is lowered at relatively high speed.

Figure 4:
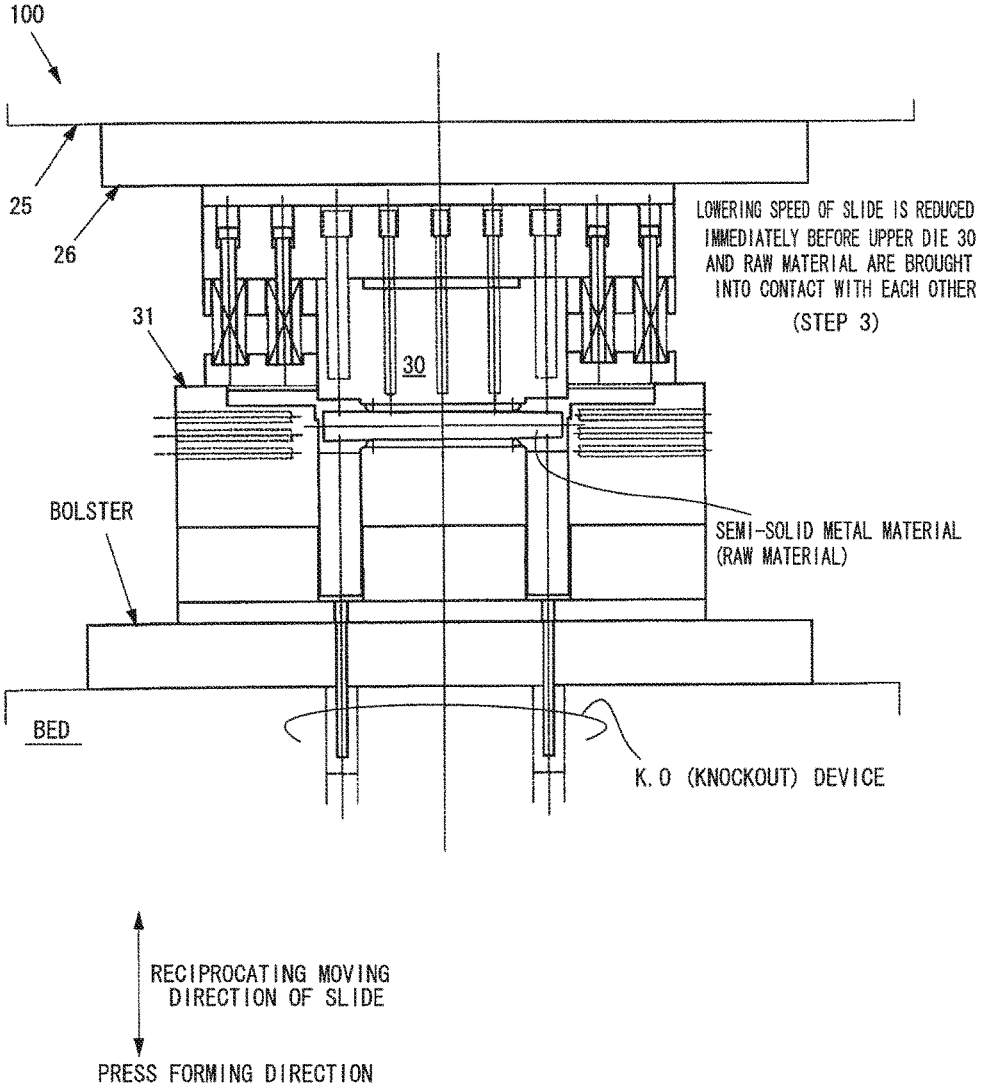
FIG. 4 is a front view of the press forming apparatus for a semi-solid metal material according to the first embodiment (under a state in which speed of the slide is reduced immediately before the slide is brought into contact with the semi-solid metal material (raw material): Step 3).

In Step 3, immediately before the upper die 30 and the semi-solid metal material (raw material) are brought into contact with each other, the lowering speed of the main slide 25 is reduced in order to prevent a spatter of a molten portion and the like of the semi-solid metal material (raw material) due to impact of contact, and to properly maintain flowing speed of the semi-solid metal material (raw material) (see FIG. 4). Note that, as a technology for varying the lowering speed of the main slide 25, there may be employed a well-known slide motion control apparatus for a mechanical press (for example, see Japanese Patent Application Laid-open No. 2013-220475).

Figure 5:
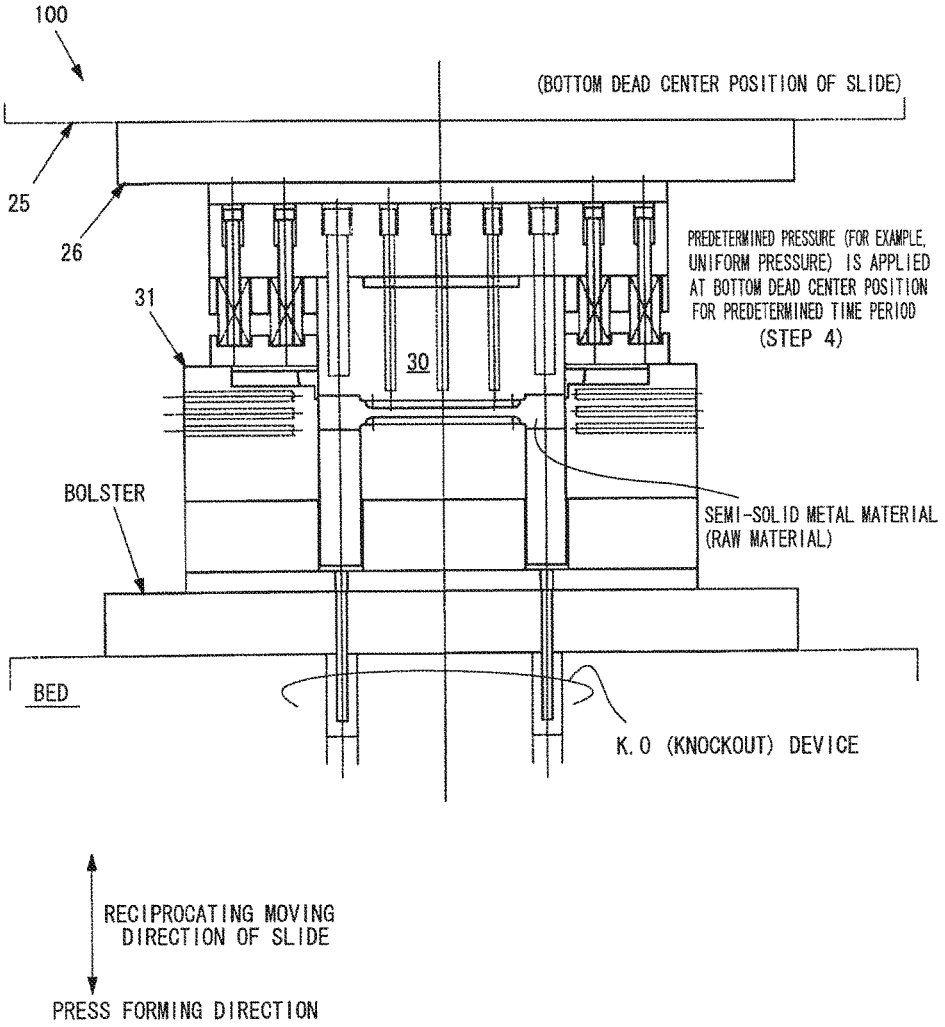
FIG. 5 is a front view of the press forming apparatus for a semi-solid metal material according to the first embodiment (under a state in which the slide is at a bottom dead center position: Step 4).

In Step 4, when the main slide 25 is lowered toward the bottom dead center and then reaches a predetermined position (for example, the bottom dead center position) (see FIG. 5), the main slide 25 is temporarily stopped, and predetermined pressure (for example, substantially uniform pressure) is applied to the semi-solid metal material (formed product) for a predetermined time period. Note that, the pressure applied to the semi-solid metal material is calculated by dividing a slide load or a press load by the area subjected to application of the pressure, and corresponds to a value proportional to the slide load or the press load.

However, the formed product is made of the semi-solid metal material. Thus, the formed product is cooled to solidify with the lapse of time, but a volume of the formed product is reduced during the solidification.

Therefore, it is extremely difficult to change the slide load in accordance with the reduction in volume of the formed product only through action of the main slide 25 connected to a crank shaft 21.

That is, in a case of such structure that the slide is moved to reciprocate by the rotary motion-reciprocating linear motion converting mechanism such as a crank mechanism as in the case of the press machine 100, there is such a characteristic that, at a vicinity of the bottom dead center, the slide load may be changed significantly due to a slight change of a crank angle. Thus, it is extremely difficult to control the slide load with good accuracy only through control of a position of the main slide 25.

Accordingly, in the first embodiment, there is described a configuration capable of controlling pressure (load) applied to the formed product (namely, the slide load (press load) applied to the main slide 25 and detected by a load sensor 18) through a hydraulic mechanism (fluid pressure mechanism) of the press machine 100.

As a method of controlling the pressure, there may be employed a well-known press load controlling apparatus for a mechanical press (for example, see Japanese Patent Application Laid-open No. 2012-86246).

Specifically, after the main slide 25 is lowered toward the bottom dead center and then the upper die 30 and the semi-solid metal material (raw material) are brought into contact with each other, the upper die 30 presses the semi-solid metal material (raw material) under pressure necessary for the semi-solid metal material (raw material) to be satisfactorily spread and filled in the cavity surrounded by the upper die 30 and the lower die 31. At this time, when the upper die 30 is lowered along the descent of the main slide 25, the pressure may be increased excessively. Accordingly, through a subsidiary slide (or sub-slide) 26 arranged between a lower surface of the main slide 25 and the upper die 30, the descent of the upper die 30 can be controlled independently of action of the main slide 25 (the upper die 30 is controlled so as to be movable relatively to the main slide 25).

In the first embodiment, as illustrated in FIG. 8, the subsidiary slide 26 is connected to the main slide 25 through intermediation of a hydraulic chamber 23. Thus, through control of magnitude of oil pressure in the hydraulic chamber 23, the predetermined pressure can be applied to the subsidiary slide 26 and also to the upper die 30 against a force of pushing up the subsidiary slide 26 from below.

In this case, for example, when the subsidiary slide 26 and also the upper die 30 are pressed down (toward the semi-solid metal material) under the predetermined pressure (when it is desired that the subsidiary slide 26 and also the upper die 30 be lowered relatively to the main slide 25), as illustrated in FIG. 8, an electric servomotor 3 drives, to a predetermined degree, a hydraulic pump 2 arranged in a hydraulic circuit connected to a hydraulic line connected to the hydraulic chamber 23. In this manner, the oil pressure in the hydraulic circuit is increased so as to reach predetermined oil pressure while the oil pressure is detected by an oil pressure sensor 11, and the oil having the predetermined pressure thus increased is fed (or supplied) into the hydraulic chamber 23.

On the other hand, for example, when the pressure applied to the semi-solid metal material is maintained to the predetermined pressure against the force of pushing up the subsidiary slide 26 and also the upper die 30 from below (from the semi-solid metal material side) (when it is desired that the subsidiary slide 26 and also the upper die 30 be raised relatively to the main slide 25), as illustrated in FIG. 8, the hydraulic circuit is switched so that the hydraulic pump 2, which is arranged in the hydraulic circuit connected to the hydraulic line connected to the hydraulic chamber 23, is driven by high-pressure oil fed from the hydraulic chamber 23 side. Further, at this time, the electric servomotor 3 controls magnitude of a load applied to the hydraulic pump 2 so that the oil pressure reaches the predetermined oil pressure while the oil pressure is detected by the oil pressure sensor 11. Thus, the oil pressure in the hydraulic chamber 23 can be controlled and maintained to the predetermined pressure.

Note that, in FIG. 8, the apparatus includes accumulators 1 and 7, a pilot-operated check valve 4, a solenoid valve 5, a relief valve (safety valve) 6, pressure sensors 11 and 12, an angular velocity sensor 13 for the servomotor, an angular velocity sensor 14 for the crank shaft 21, an angular position sensor 16 for the crank shaft 21, a position sensor 17 for the subsidiary slide, a load sensor 18 for the slide, the crank shaft 21, and a connecting rod 22.

Figure 6:
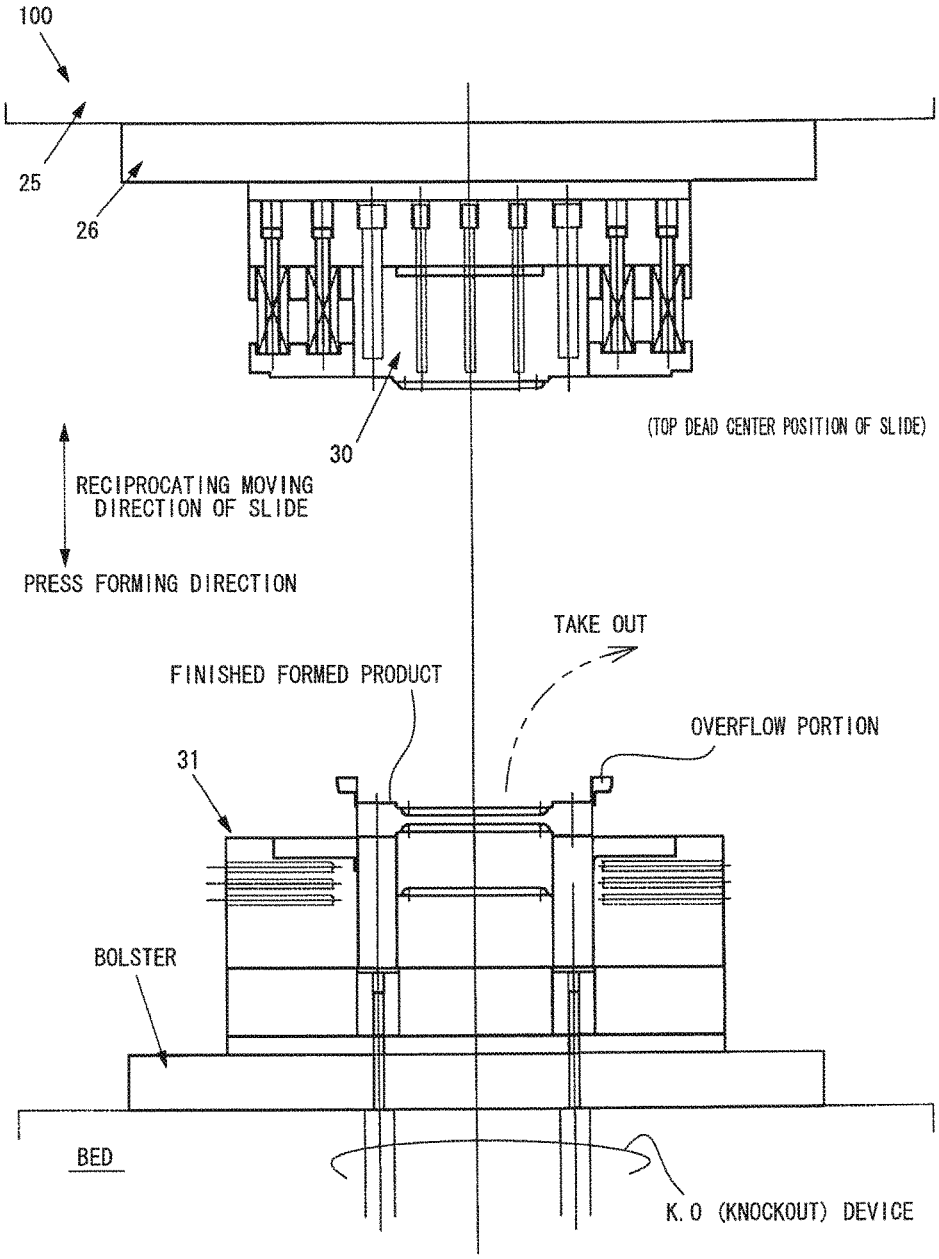
FIG. 6 is a front view of the press forming apparatus for a semi-solid metal material according to the first embodiment (under a state in which a finished formed product is taken out while the slide is at the top dead center position: Step 5).

Then, after finish of forming in Step 4, in Step 5, the main slide 25 is started to make upward movement from the bottom dead center position. After the main slide 25 is raised from the bottom dead center position by a predetermined amount (for example, approximately 10 mm), the formed product placed in the lower die 31 is pushed up by a knockout device, thereby taking the formed product out of the lower die 31 (see FIG. 6).

As described above, in the first embodiment, the subsidiary slide 26 and also the upper die 30 arranged integrally with the subsidiary slide 26 can be moved independently of moving action of the main slide 25 (the subsidiary slide 26 and also the upper die 30 arranged integrally with the subsidiary slide 26 are constructed so as to be movable relatively to the main slide 25), and the pressure applied to the subsidiary slide 26 and also to the lower surface of the upper die 30 (press load applied to the main slide 25 and detected by the load sensor 18) can be controlled to desired pressure through control of the oil pressure in the hydraulic chamber 23 arranged between the main slide 25 and the subsidiary slide 26. Accordingly, even if the volume is reduced when the semi-solid metal material is cooled to solidify with the lapse of time during press forming, the subsidiary slide 26 and also the upper die 30 can be lowered independently of the main slide 25 in accordance with the volume reduction, and predetermined (for example, substantially uniform) forming pressure (slide load, press load) can be continuously applied to the semi-solid metal material in the cavity for a predetermined time period.

Therefore, according to the first embodiment, it is possible to obtain the formed product that is free from defects such as a shrinkage cavity, a shrinkage hole, and a blowhole, and is excellent in mechanical properties.

Now, the press forming according to the first embodiment is described with reference to a timing chart illustrated in FIG. 9.

As described above, in Step 2 (in FIG. 9, "S" represents "Step"; the same holds true for the following description), until the upper die 30 and the semi-solid metal material (raw material) are brought into contact with each other, the main slide 25 is lowered at relatively high speed. At this time, the subsidiary slide 26 is brought into abutment on a stopper portion 25A by the oil pressure in the hydraulic chamber (hydraulic piston) 23.

In Step 3 (S3), immediately before the upper die 30 and the semi-solid metal material (raw material) are brought into contact with each other, the lowering speed of the main slide 25 is reduced.

Figure 9:
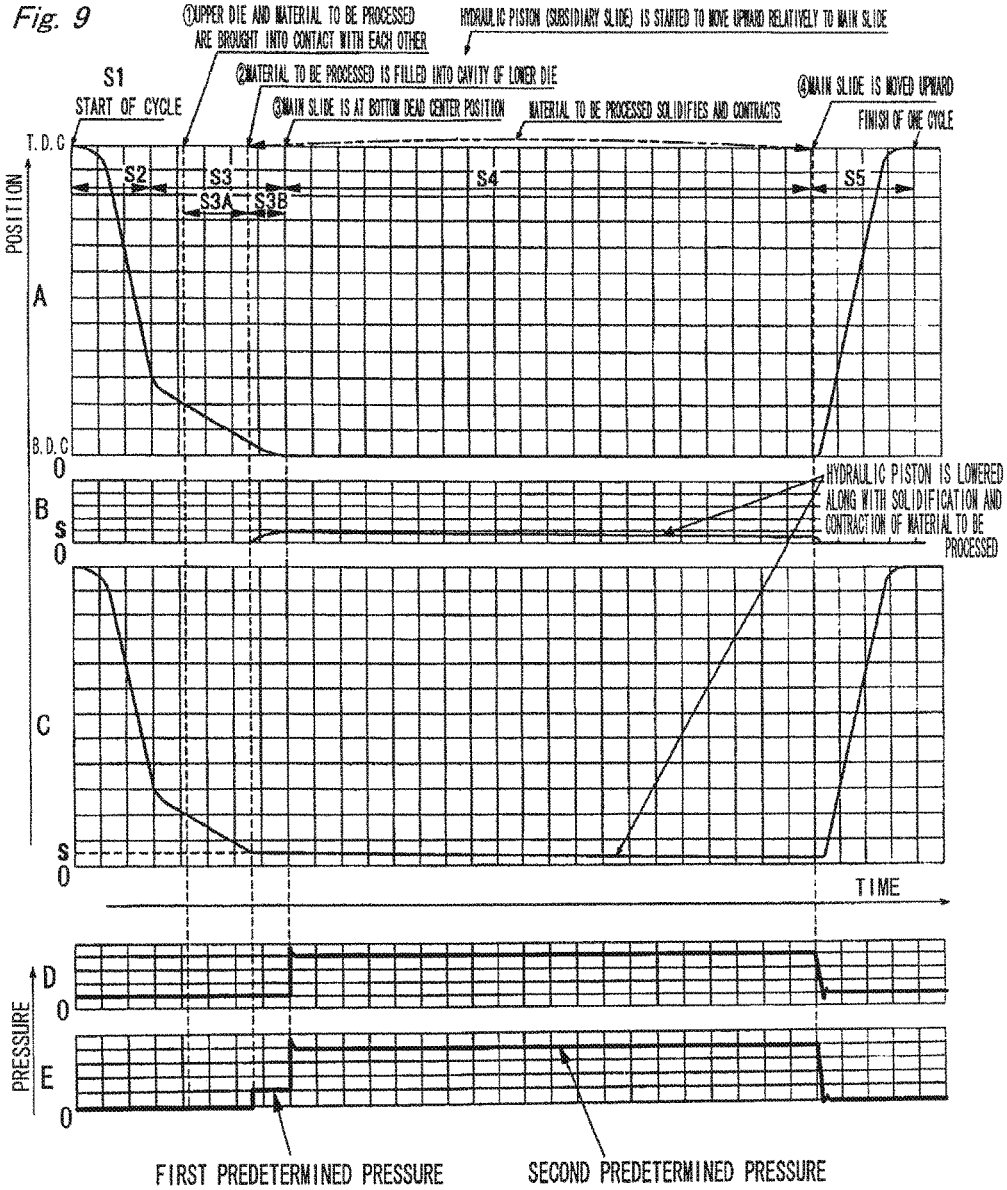
FIG. 9 is a timing chart for illustrating press forming performed by the press forming apparatus for a semi-solid metal material according to the first embodiment.

Then, in the first embodiment, as indicated by S3A of FIG. 9, after the upper die 30 and the semi-solid metal material (raw material) are brought into contact with each other, until the semi-solid metal material (raw material) is filled into the cavity surrounded by the lower die 31 and the upper die 30, the main slide 25 is lowered at appropriate speed capable of filling the semi-solid material into the cavity surrounded by the lower die 31 and the upper die 30 while preventing a spatter of the semi-solid metal material (raw material). Note that, at this time, the subsidiary slide 26 is urged downward by the oil pressure in the hydraulic chamber 23 to be held in abutment on the stopper portion 25A under the predetermined pressure. That is, a stroke amount of upward relative movement of the subsidiary slide 26 to the main slide 25 (see the part B of FIG. 9) is zero.

Then, after the semi-solid material is filled into the cavity surrounded by the lower die 31 and the upper die 30, as indicated by S3B of FIG. 9, the oil pressure in the hydraulic chamber (hydraulic piston) 23 is controlled while preventing the pressure from being applied more than necessary to the semi-solid metal material (raw material) in the cavity surrounded by the lower die 31 and the upper die 30. Thus, predetermined pressure (substantially uniform first predetermined pressure) is applied to the semi-solid metal material (raw material) (see the part E of FIG. 9). The details of this control correspond to details of the invention according to claims 2 and 3.

Through this control of the oil pressure in the hydraulic chamber (hydraulic piston) 23, the subsidiary slide 26 is moved upward along with the descent of the main slide 25 (see the part B of FIG. 9).

Therefore, as indicated by S3B of FIG. 9, a descent amount of the main slide 25 (position of the main slide) and an upward stroke amount S of the subsidiary slide 26 (see the part B of FIG. 9) are summed up, thereby keeping a vertical position of the upper die 30 (distance from the lower die 31 or an upper surface of a bolster) at a substantially fixed position (see the part C of FIG. 9). In this manner, under appropriate pressure (first predetermined pressure), the semi-solid material can be filled into the cavity surrounded by the lower die 31 and the upper die 30.

In subsequent Step 4 (S4), when the main slide 25 is lowered toward the bottom dead center position and then reaches a predetermined position (for example, the bottom dead center position), the main slide 25 is temporarily stopped, and predetermined pressure (for example, substantially uniform pressure) is applied to the formed product for a predetermined time period. However, the formed product is made of the semi-solid metal material. Thus, the formed product is cooled to solidify with the lapse of time, and hence a volume of the formed product is reduced during the solidification. Accordingly, as indicated by S4 of FIG. 9, through control of the oil pressure in the hydraulic chamber 23, the subsidiary slide 26 is moved downward in accordance with the volume reduction (see the part B of FIG. 9) so that predetermined pressure (second predetermined pressure, second press load) can be applied to the semi-solid metal material for a predetermined time period even when the volume is reduced (see the part E of FIG. 9). In this manner, the upper die 30 is gradually lowered toward the semi-solid metal material (see the part C of FIG. 9). The details of this control correspond to details of the invention according to claim 1.

Note that, in Step 4 (S4), the main slide 25 is temporarily stopped at the bottom dead center position. However, when a desired press load can be generated even at another position except for the bottom dead center, the main slide 25 may be temporarily stopped at another position except for the bottom dead center.

Then, after finish of forming in Step 4, the procedure of the press forming proceeds to Step 5 (S5), and then returns to Step 1. Step 2 (S2) to Step 5 (S5) are repeated, thereby carrying out the press forming continuously.

Figure 10A:
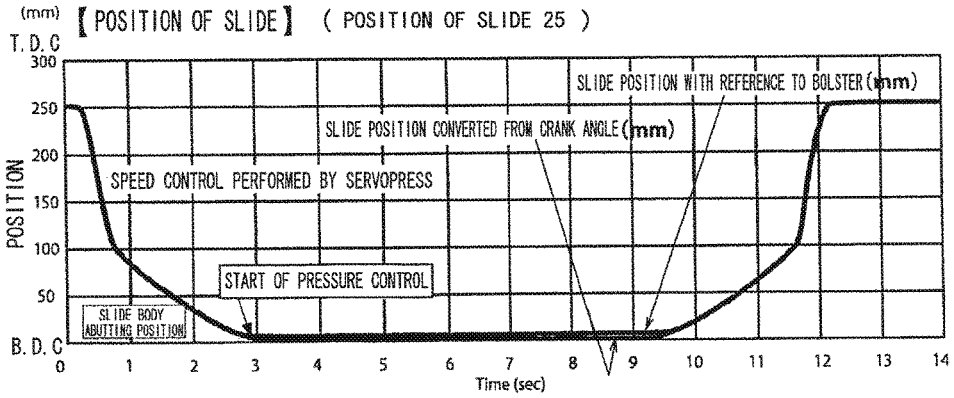
FIG. 10A is a timing chart for illustrating a position of the slide in the press forming performed by the press forming apparatus for a semi-solid metal material according to the first embodiment.
Figure 10B:
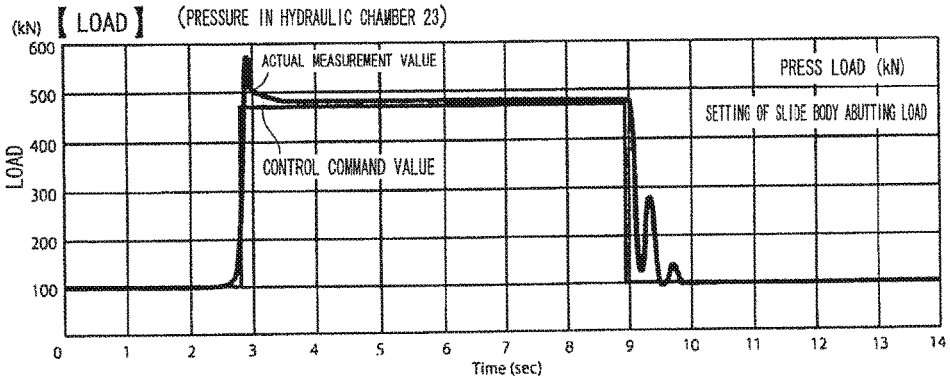
FIG. 10B is a load (slide load, press forming load) in the press forming performed by the press forming apparatus for the semi-solid metal material according to the first embodiment.

In a timing chart of FIGS. 10A and 10B, there are illustrated results of measurement of an actual position of the slide (state of movement of the main slide) and the pressure (corresponding to the slide load (press load)) in the hydraulic chamber 23.

As described above, according to the first embodiment, while the main slide 25 is at the bottom dead center, predetermined forming pressure (slide load, press load) can be continuously applied to the semi-solid metal material in the cavity for a predetermined time period. Thus, it is possible to obtain the formed product that is free from defects such as a shrinkage cavity, a shrinkage hole, and a blowhole, and is excellent in mechanical properties.

As described above, according to the first embodiment, the upper die 30 is mounted to the main slide 25 through intermediation of the subsidiary slide 26 that is movable independently of action of the main slide 25, and the hydraulic mechanism (fluid pressure mechanism) including the hydraulic chamber 23 and the like is arranged between the main slide 25 and the subsidiary slide 26. With this configuration, through control of the oil pressure in the hydraulic chamber 23, a relative position of the subsidiary slide 26 to the main slide 25 can be controlled. Thus, the main slide 25 is lowered and then stopped after reaching a predetermined position, and under this state, predetermined forming pressure (slide load, press load) can be continuously applied to the semi-solid metal material for a predetermined time period (see S4 of FIG. 9). Accordingly, it is possible to obtain the formed product that is free from defects such as a shrinkage cavity, a shrinkage hole, and a blowhole, and is excellent in mechanical properties.

That is, it is extremely difficult to change the slide load in accordance with the reduction in volume of the formed product only through action of the main slide 25 connected to the crank shaft 21 configured to convert the rotary motion into the reciprocating linear motion (there is such a characteristic that, at the vicinity of the bottom dead center, the slide load may be changed significantly due to the slight change of the crank angle, and hence it is extremely difficult to control the slide load with good accuracy only through control of the position of the main slide 25). However, in the first embodiment, through the hydraulic mechanism of the press machine 100, the pressure (load) (namely, the slide load (press load) applied to the main slide 25 and detected by the load sensor 18) applied to the formed product (material to be processed) can be controlled easily with good accuracy. In this manner, predetermined forming pressure (slide load, press load) can be continuously applied to the semi-solid metal material for a predetermined time period. Accordingly, it is possible to obtain the formed product that is free from defects such as a shrinkage cavity, a shrinkage hole, and a blowhole, and is excellent in mechanical properties.

Further, in the first embodiment, when the main slide 25 is lowered to bring the upper die 30 into contact with the semi-solid metal material and then the semi-solid metal material is filled into the cavity surrounded by the lower die 31 and the upper die 30 (see S3A of FIG. 9), the oil pressure in the hydraulic chamber 23 is controlled while preventing the pressure from being applied more than necessary to the semi-solid metal material in the cavity surrounded by the lower die 31 and the upper die 30, and the subsidiary slide 26 is moved upward along with the descent of the main slide 25 so that the predetermined pressure (first predetermined pressure, first press load) is applied to the semi-solid metal material. Accordingly, before forming in S4 of FIG. 9, under appropriate pressure, the semi-solid metal material can be filled into the cavity surrounded by the lower die 31 and the upper die 30. Thus, the semi-solid metal material in the cavity can be dispersed homogeneously, thereby being capable of avoiding difficulty in ensuring homogeneous and stable quality, which may result from no assurance of homogeneity in an entire region of the raw material (semi-solid metal material), occurrence of local fluctuation in structure and composition of a product, or local insufficiency of mechanical strength. Accordingly, it is possible to obtain a press-formed product that is homogeneous and excellent in mechanical strength with high quality.

Still further, in the first embodiment, after charging the semi-solid metal material (raw material), the main slide 25 is lowered to start forming action. Until immediately before the upper die 30 is brought into contact with the semi-solid metal material (raw material) (see FIG. 3 or FIG. 9), the main slide 25 is lowered at relatively high speed (see Step 2), thereby enhancing production speed and also production efficiency. Meanwhile, immediately before the upper die 30 and the semi-solid metal material (raw material) are brought into contact with each other, the lowering speed of the main slide 25 is reduced. As a result, it is possible to prevent a spatter of the molten portion and the like of the semi-solid metal material (raw material) due to impact of contact, and to properly maintain flowing speed of the semi-solid metal material (raw material). Accordingly, it is possible to both enhance productivity and obtain the formed product that is free from defects such as a shrinkage cavity, a shrinkage hole, and a blowhole, and is excellent in mechanical properties.

As described above, in the related-art method of forming the semi-solid metal material, in order to cope with the problem of shrinkage (volume reduction), it is necessary to divide the upper die or the lower die into a plurality of pieces, and to cause the divided pieces of the die to make relative movement in accordance with shrinkage, thereby changing a cavity volume of the die. For example, a minute gap is formed between the divided pieces of the die, which may adversely affect quality of the formed product, and may lead to increase in cost and complication of the apparatus and equipment. In addition, in actuality, it is difficult to apply the related-art method to press forming to be performed under high pressure, and problems relating to durability and reliability may arise. However, according to the first embodiment, the problem of shrinkage can be coped with by employing a relatively simple configuration in which the subsidiary slide 26 is moved relatively to the main slide 25. Accordingly, it is possible to provide a press forming method and a press forming apparatus for a semi-solid material, which are capable of obtaining, with a simple and low-cost configuration, the formed product that is free from defects such as a shrinkage cavity, a shrinkage hole, and a blowhole, and is excellent in mechanical properties.

Note that, the press machine 100 according to the first embodiment is a press machine including the mechanism configured to convert the rotary motion of the power source into the reciprocating linear motion of the slide (die). As the power source, any one of a rotary motion of a flywheel, a servomotor, and the like may be adopted.

Second Embodiment

In a second embodiment of the present invention, in addition to the configuration of the first embodiment, vibration strokes are applied to the upper die after the upper die and the raw material are brought into contact with each other.

Step 1 and Step 2 are carried out in the same way as those of the first embodiment.

Figure 11:
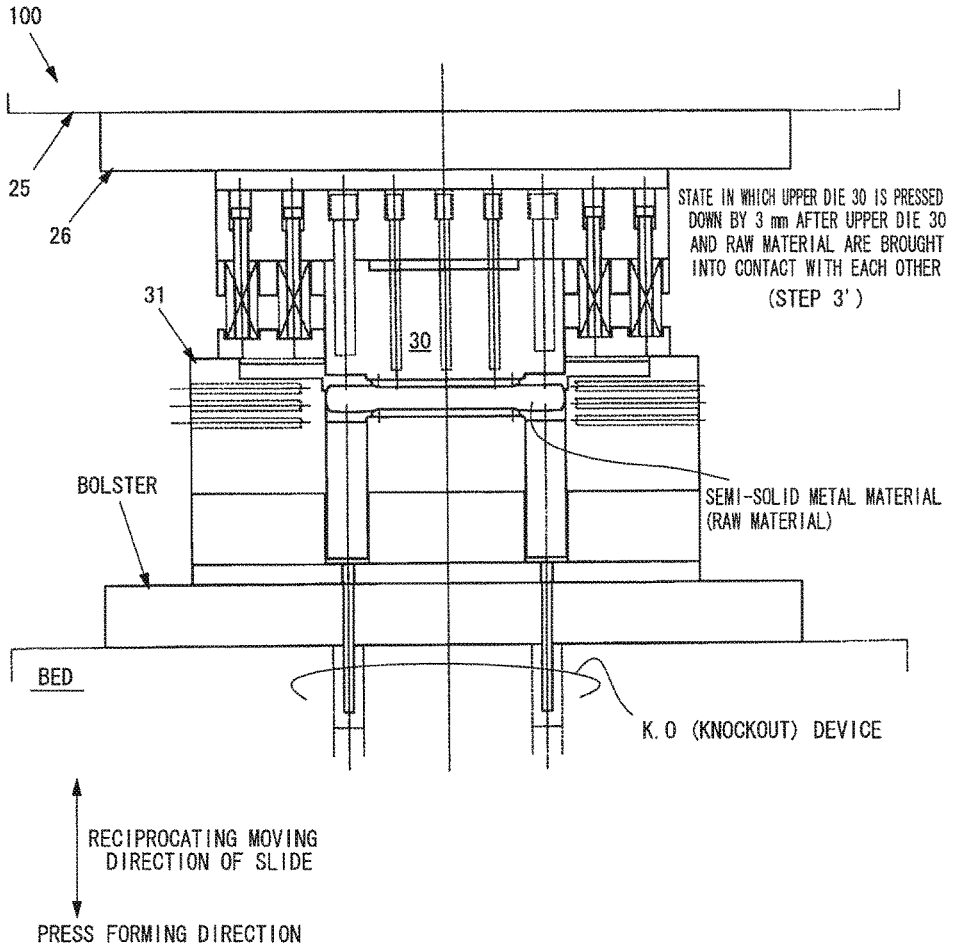
FIG. 11 is a front view of a press forming apparatus for a semi-solid metal material according to a second embodiment of the present invention (under a state in which an upper die is pressed down by 3 mm after the upper die and the semi-solid metal material (raw material) are brought into contact with each other: Step 3').
Figure 12:
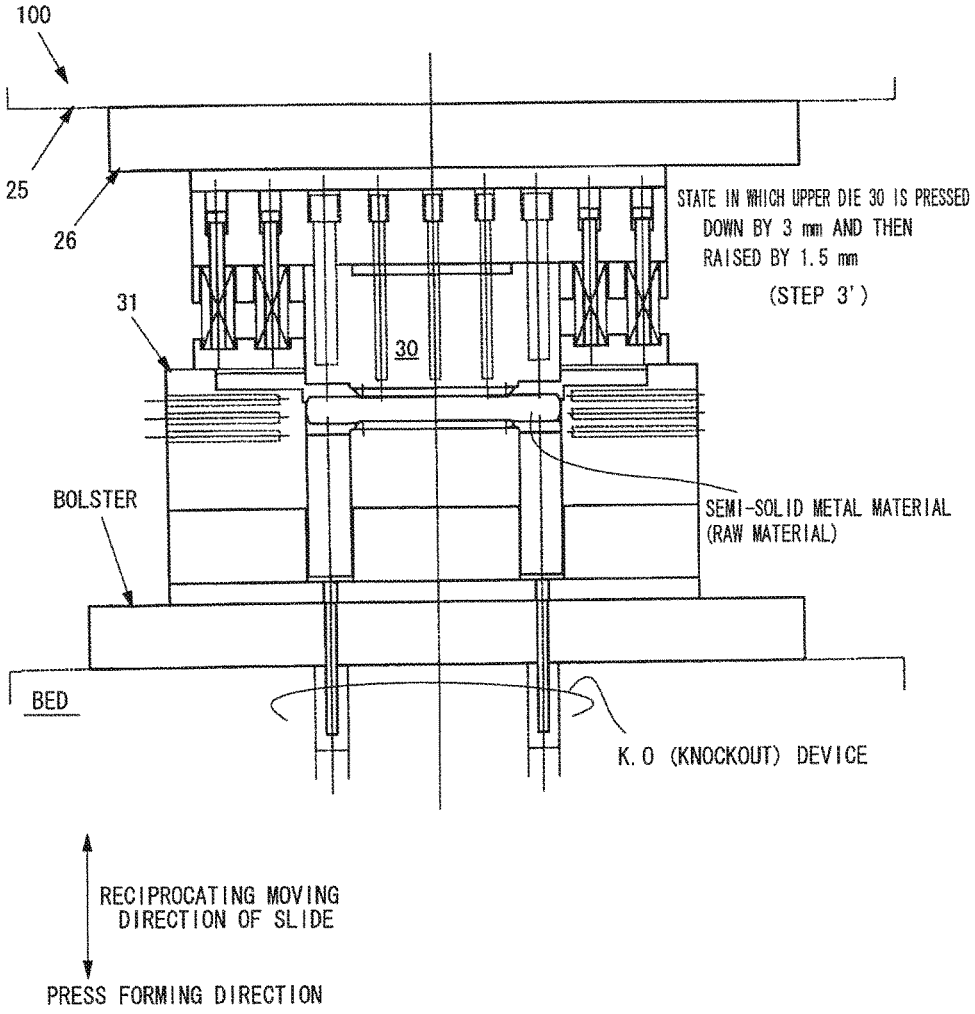
FIG. 12 is a front view of the press forming apparatus for a semi-solid metal material according to the second embodiment (under a state in which the upper die is raised by 1.5 mm from the state illustrated in FIG. 11: Step 3').

In Step 3', immediately before or immediately after the upper die 30 and the semi-solid metal material (raw material) are brought into contact with each other, there is repeated operation of vertically moving the upper die 30 in such a manner that, independently of action of the main slide 25, the upper die 30 is pressed down by a certain distance and then raised by a certain distance. For example, there is repeated operation of vertically moving the upper die 30 in such a manner that the upper die 30 is pressed down by 3 mm (see FIG. 11) and then raised by 1.5 mm (see FIG. 12). Consequently, the upper die 30 is caused to reach the bottom dead center in 2.5 seconds. As an example of a frequency of the vertical movement (vibration), approximately 0.8 Hz to 11.6 Hz is assumed. Amplitude of vibration is not limited to the above-mentioned example, and may be set to, for example, 0.04 mm or more.

Note that, as a technology for causing the die to make upward and downward sliding movement, for example, the technology described in Japanese Patent Application Laid-open No. 2014-144470 may be employed. The details of this control correspond to details of the invention according to claims 2 and 4.

Specifically, as illustrated in FIG. 8, the upper hydraulic chamber 23 for pressing the subsidiary slide 26 downward from above relatively to the main slide 25, and a lower hydraulic chamber 24 for pushing the subsidiary slide 26 upward from below relatively to the main slide 25 are alternately subjected to oil pressure application (carried out by using the accumulator 1 or 7, the hydraulic pump 2, the electric servomotor 3, and the like) and oil pressure release in a repeated manner. Thus, there is repeated operation of pressing down the upper die 30 by a certain distance and then raising the upper die 30 by a certain distance independently of action of the main slide 25, thereby being capable of vibrating the upper die 30.

Figure 13:
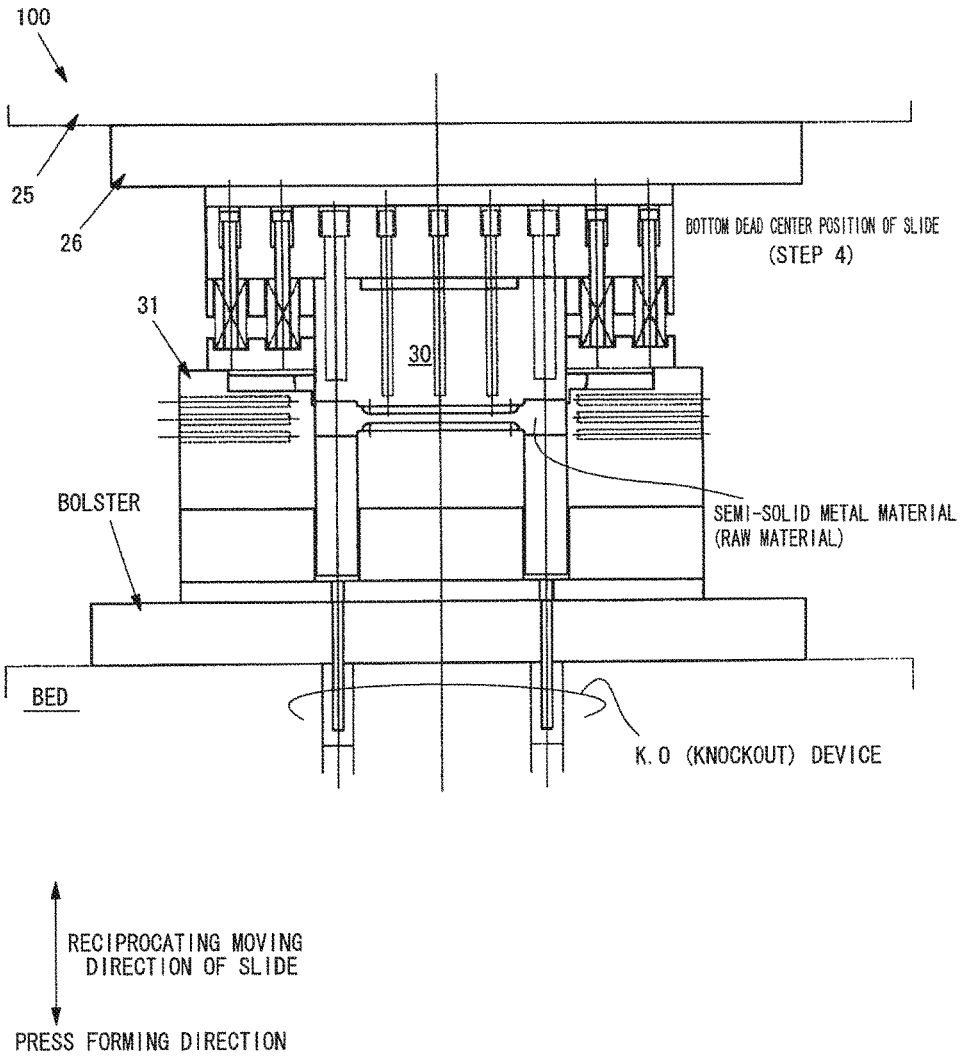
FIG. 13 is a front view of the press forming apparatus for a semi-solid metal material according to the second embodiment (under a state in which a slide is at a bottom dead center position: Step 4).

When the main slide 25 reaches a predetermined position (for example, a bottom dead center position) (see FIG. 13), Step 4 is carried out similarly to the first embodiment. That is, the main slide 25 is temporarily stopped, and predetermined pressure (for example, substantially uniform pressure) is applied to the formed product for a predetermined time period (press forming is performed similarly to the first embodiment).

Figure 14:
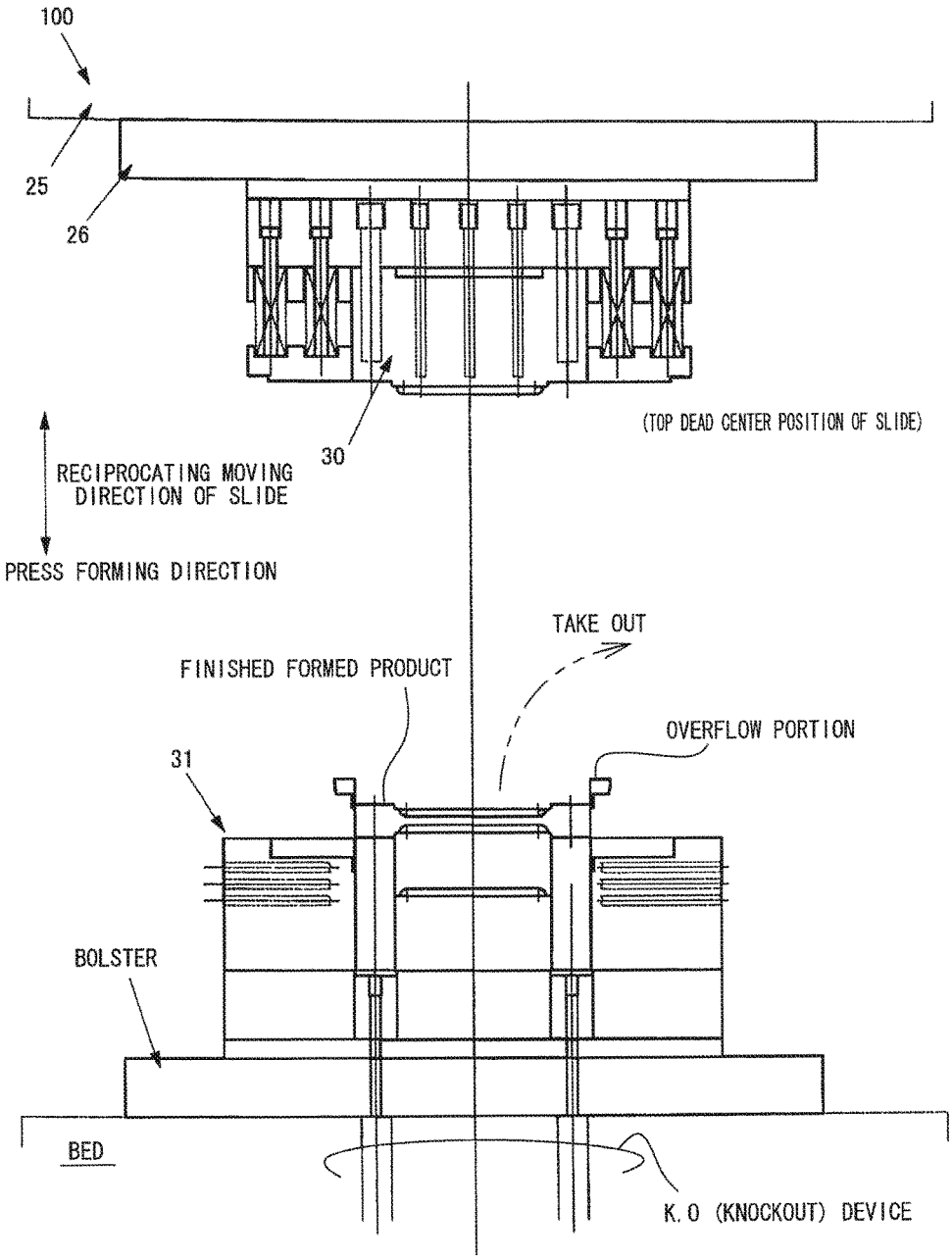
FIG. 14 is a front view of the press forming apparatus for a semi-solid metal material according to the second embodiment (under a state in which a finished formed product is taken out while the slide is at a top dead center position: Step 5).

After that, similarly to the first embodiment, in Step 5, the main slide 25 is started to make upward movement from the bottom dead center position. After the main slide 25 is raised from the bottom dead center position by a predetermined amount (for example, approximately 10 mm), the formed product placed in the lower die 31 is pushed up by the knockout device, thereby taking the formed product out of the lower die 31 (see FIG. 14).

According to the second embodiment, in addition to operations and effects of the first embodiment, pressure is applied under vibration in the second embodiment, and hence the semi-solid metal material is subjected to short-time pressure application and short-time pressure release in a repeated manner. Accordingly, it is assumed that an inside of the semi-solid metal material (semi-solid aluminum alloy slurry) is in a semi-solid state, whereas an outer peripheral portion of the semi-solid metal material is cooled due to contact with the die and the outside air to be brought into a hot deformed state. Thus, owing to the short-time pressure release, stress generated on an outer surface of the semi-solid metal material (semi-solid aluminum alloy slurry) by hot plastic working can be alleviated, and hence plastic flow can be changed. Consequently, generation of a defect such as a crack can be prevented.

Further, the die is elastically deformed by the load applied during press forming. However, when the pressure is released as in the second embodiment, forming is performed after the die is restored from the elastic deformation. Thus, press forming with high dimension accuracy is possible.

In addition, when the pressure is applied under vibration as in the second embodiment, a lubricant (with oiliness) can flow into the cavity again. Thus, it is possible to prevent the formed product from adhering to the die.

Third Embodiment

In a third embodiment of the present invention, in addition to the configuration of the first embodiment, the bottom dead center position of the slide (upper die) is set at two positions, namely, a virtual (or imaginary) bottom dead center position and a real bottom dead center position, and pressure is applied under vibration.

Step 1, Step 2, and Step 3 are carried out in the same way as those of the first embodiment.

Figure 15:
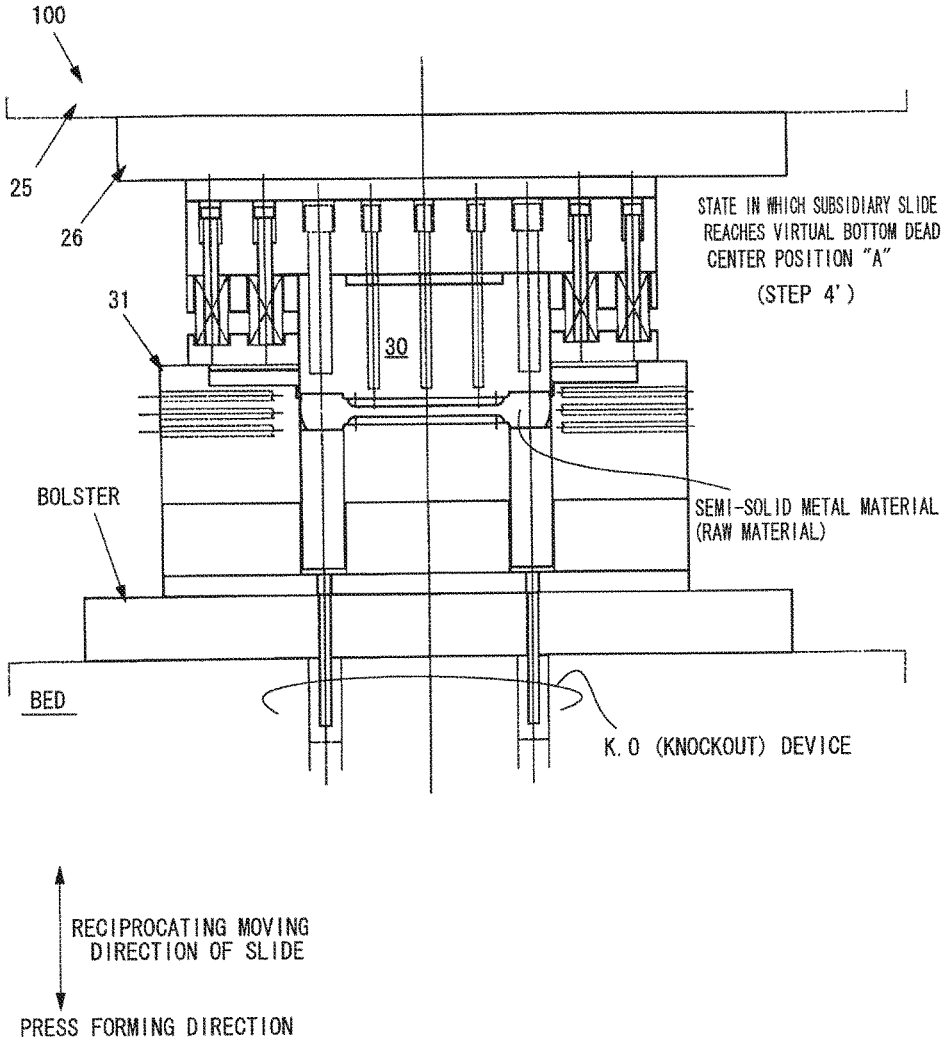
FIG. 15 is a front view of a press forming apparatus for a semi-solid metal material according to a third embodiment of the present invention (under a state in which a slide is at a virtual bottom dead center position "A": Step 4').

In the third embodiment, in Step 4', under a state in which the main slide 25 (the subsidiary slide 26 and also the upper die 30) reaches a virtual bottom dead center position "A" set in front of (above) the actual bottom dead center position of the slide (see FIG. 15), in the same way as that of the first embodiment, predetermined pressure is applied to the semi-solid metal material (raw material) for a predetermined time period, and then solidification is completed.

Figure 16:
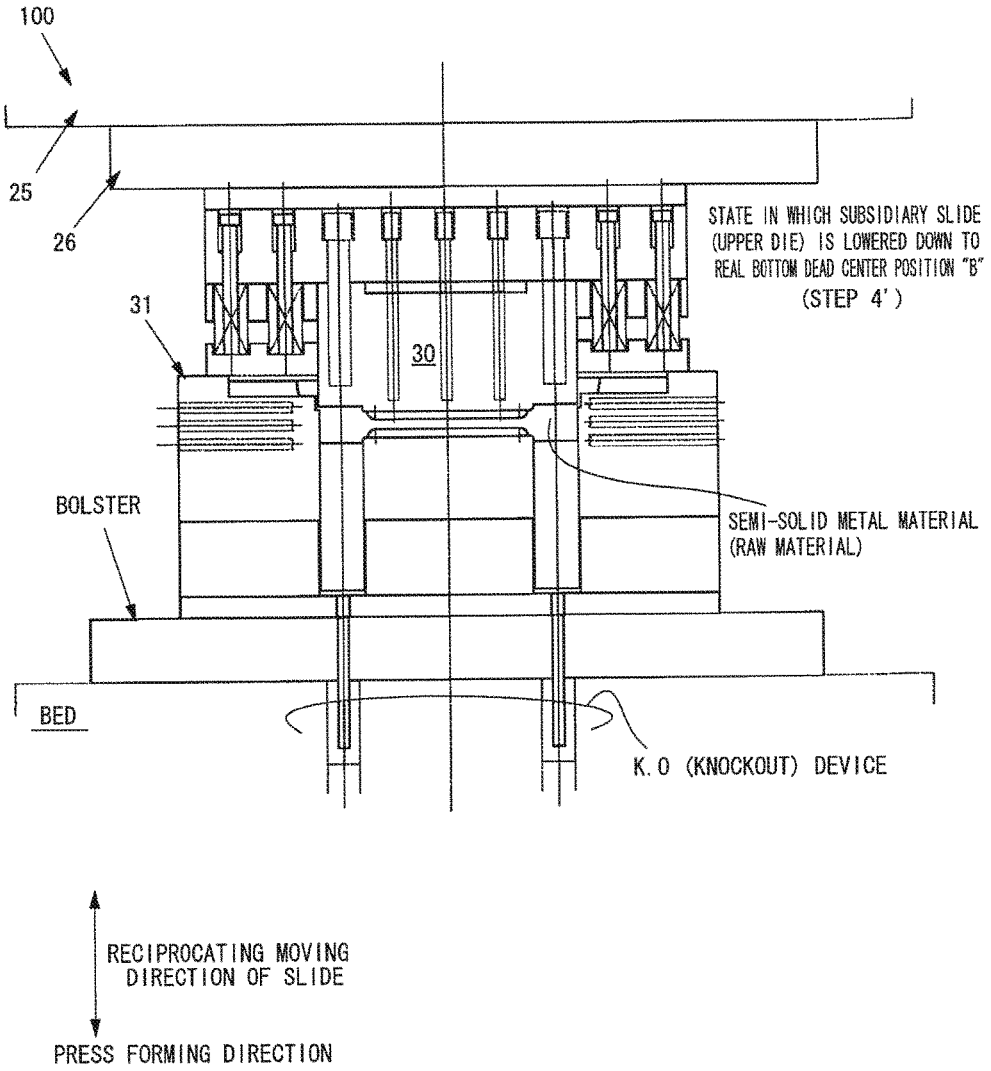
FIG. 16 is a front view of the press forming apparatus for a semi-solid metal material according to the third embodiment (under a state in which the slide is at a real bottom dead center position "B": Step 4').

After that, the subsidiary slide 26 (upper die 30) is lowered down to a real bottom dead center position "B" (a height from the bolster: A>B) that is set to obtain dimensions needed as a finished press-formed product (final product) (see FIG. 16).

Figure 17A:
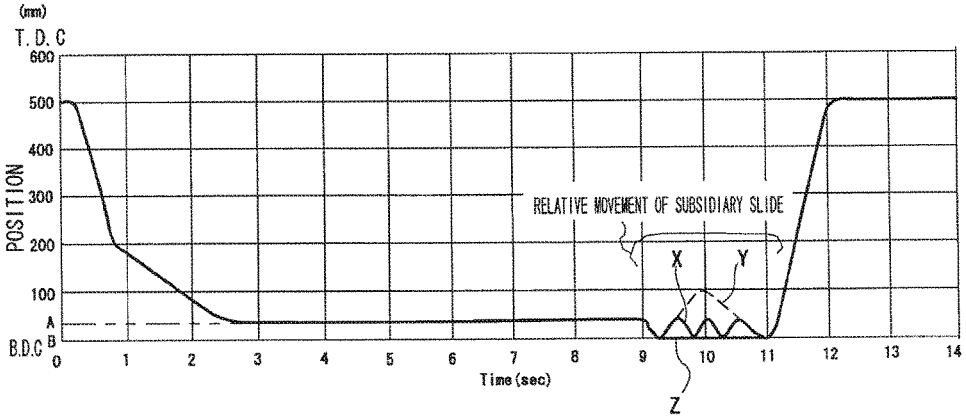
FIG. 17A is a timing chart for illustrating a position of the slide and a load (slide load, press forming load) in press forming performed by the press forming apparatus for a semi-solid metal material according to the third embodiment.

At this time, as indicated by the undulating line X of FIG. 17A, for example, the following forming method may be adopted. Specifically, in the same method as the method of applying pressure under vibration according to the second embodiment, the semi-solid metal material is formed while being subjected to short-time pressure application and short-time pressure release in a repeated manner.

Alternatively, as indicated by the curved line Y of FIG. 17A, for example, the following forming method may be adopted. Specifically, the same method as the method of applying pressure under vibration according to the second embodiment is employed, but the semi-solid metal material is formed while being subjected to two-time pressure application (one-time pressure release) under a condition that amplitude of application of pressure under vibration is increased and a cycle time period (vibration period) is elongated.

Figure 17B:
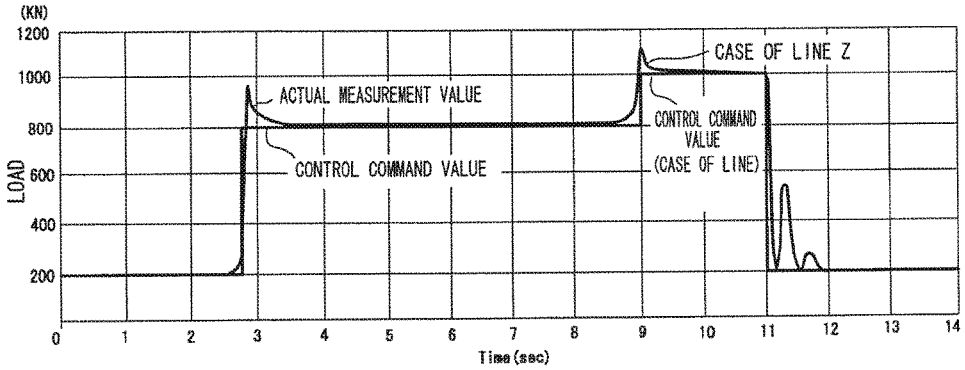
FIG. 17B is a load (slide load, press forming load) in press forming performed by the press forming apparatus for a semi-solid metal material according to the third embodiment.

Alternatively, the following forming method may be adopted. Specifically, by the same method as those according to the first embodiment and the second embodiment, the subsidiary slide 26 is lowered independently of the main slide 25, and the pressure in the hydraulic chamber 23 is increased to predetermined pressure. Thus, as indicated by the straight line Z of FIG. 17A, application of pressure is rapidly switched so that pressure (slide load) higher than the pressure applied at the virtual bottom dead center position "A" is applied at the real bottom dead center position "B". In this manner, the semi-solid metal material is formed (see a change in load (pressure) illustrated in a timing chart of FIG. 17B).

The details of the above-mentioned various types of control (details of control indicated by the lines X, Y, and Z of FIG. 17A) correspond to details of the invention according to claim 5.

As described above, when performing press forming while applying the predetermined pressure (press load) to the semi-solid metal material in the cavity for a predetermined time period after the slide reaches the bottom dead center (including the virtual bottom dead center), pressure is applied under vibration to the semi-solid metal material (raw material) by the subsidiary slide 26 (upper die 30). As a result, the already solidified material can be subjected to warm plastic working. Accordingly, it is possible to obtain more compact forged structure that has similarity to a forged product and undergoes flow of the material.

Therefore, according to the third embodiment, in the same way as in the first embodiment and the second embodiment, it is possible to obtain the formed product that is free from defects such as a shrinkage cavity, a shrinkage hole, and a blowhole, and is excellent in mechanical properties. Further, it is possible to obtain the formed product that is enhanced in strength and ductility.

Note that, in particular, in a case of a die assembly in which the upper die 30 and the lower die 31 are not brought into abutment on each other but the upper die 30 is fitted into the lower die 31 so that dimension accuracy of the formed product is expected in accordance with accuracy of a stop position of the press machine (slide), the amount of plastic working is estimated previously, and a solidification position (virtual bottom dead center position "A") of the semi-solid metal material (slurry) is determined. Under this condition, the material is subjected to warm forging until the press machine reaches the real bottom dead center position "B". Thus, enhancement of dimension accuracy can be achieved, and material structure can be changed, thereby achieving increase in strength and the like.

Note that, in the above description, description is made with reference to the mechanism configured to move the subsidiary slide 26 relatively to the main slide 25 by using the oil pressure, but the present invention is not limited thereto. The present invention is also applicable to a mechanism using another fluid pressure.

Incidentally, as the semi-solid metal material, for example, an aluminum alloy may be employed, and another metal or another kind of alloy may also be employed.

As described above, the present invention can provide the press forming apparatus and the press forming method for a semi-solid metal material using the press machine including the mechanism configured to convert the rotary motion of the power source into the reciprocating linear motion of the slide (die). The press forming apparatus and the press forming method are capable of obtaining, with the simple and low-cost configuration, the formed product that is free from defects such as a shrinkage cavity, a shrinkage hole, and a blowhole, and is excellent in mechanical properties.

The embodiments described above are merely examples for describing the present invention. It goes without saying that various modifications may be made without departing from the gist of the present invention.

What is claimed is:

1. A press forming apparatus for a semi-solid metal material, comprising:

a slide caused to make a reciprocating linear motion by a mechanism configured to convert a rotary motion of a power source into the reciprocating linear motion;

a subsidiary slide mounted so as to be movable relative to the slide in a reciprocating moving direction of the slide;

a fluid pressure mechanism interposed between the slide and the subsidiary slide, the fluid pressure mechanism moving the subsidiary slide relative to the slide by fluid pressure;

an upper die mounted to the subsidiary slide; and a lower die, the press forming apparatus being configured to press-form the semi-solid metal material while applying predetermined pressure to the semi-solid metal material for a predetermined time period by bringing, along with descent action of the slide, the upper die into contact with the semi-solid metal material fed into the lower die, then stopping the slide at a predetermined position, and moving the upper die mounted to the subsidiary slide relative to the slide by the fluid pressure mechanism under a state in which the slide is stopped, wherein until the slide is stopped at the predetermined position after bringing, along with the descent action of the slide, the upper die mounted to the subsidiary slide into contact with the semi-solid metal material fed into the lower die, and while the slide performs the descent action, pressure applied to the semi-solid metal material is controlled to the predetermined pressure by moving the upper die mounted to the subsidiary slide upward relative to the slide by the fluid pressure mechanism.

2. A press forming apparatus for a semi-solid metal material according to claim 1, wherein the pressure applied to the semi-solid metal material is controlled to the predetermined pressure by controlling the pressure to substantially uniform pressure.

3. A press forming apparatus for a semi-solid metal material according to claim 1, wherein the pressure applied to the semi-solid metal material is controlled to the predetermined pressure by controlling the pressure under predetermined vibration.

4. A press forming apparatus for a semi-solid metal material according to claim 1, wherein while applying the predetermined pressure to the semi-solid metal material for the predetermined time period, the pressure applied to the semi-solid metal material is switched to another predetermined pressure.

5. A press forming method for a semi-solid metal material using a press machine, the press machine comprising:

a slide caused to make a reciprocating linear motion by a mechanism configured to convert a rotary motion of a power source into the reciprocating linear motion;

a subsidiary slide mounted so as to be movable relative to the slide in a reciprocating moving direction of the slide;

a fluid pressure mechanism interposed between the slide and the subsidiary slide, the fluid pressure mechanism moving the subsidiary slide relative to the slide by fluid pressure;

an upper die mounted to the subsidiary slide; and a lower die, the press forming method comprising press-forming the semi-solid metal material while applying predetermined pressure to the semi-solid metal material for a predetermined time period by bringing, along with descent action of the slide, the upper die into contact with the semi-solid metal material fed into the lower die, then stopping the slide at a predetermined position, and moving the upper die mounted to the subsidiary slide relative to the slide by the fluid pressure mechanism under a state in which the slide is stopped, the press forming method further comprising controlling, until the slide is stopped at the predetermined position after bringing, along with the descent action of the slide, the upper die mounted to the subsidiary slide into contact with the semi-solid metal material fed into the lower die, and while the slide performs the descent action, pressure applied to the semi-solid metal material to the predetermined pressure by moving the upper die mounted to the subsidiary slide upward relative to the slide by the fluid pressure mechanism.

6. A press forming method for a semi-solid metal material according to claim 5, wherein the controlling the pressure applied to the semi-solid metal material to the predetermined pressure comprises controlling the pressure to substantially uniform pressure.

7. A press forming method for a semi-solid metal material according to claim 5, wherein the controlling the pressure applied to the semi-solid metal material to the predetermined pressure comprises controlling the pressure under predetermined vibration.

8. A press forming method for a semi-solid metal material according to claim 5, further comprising switching, while applying the predetermined pressure to the semi-solid metal material for the predetermined time period, the pressure applied to the semi-solid metal material to another predetermined pressure.

* * * * *